US006273111B1

(12) United States Patent
Weiss et al.

(10) Patent No.: US 6,273,111 B1
(45) Date of Patent: Aug. 14, 2001

(54) RETRACTABLE UMBRELLA

(76) Inventors: David Weiss, 1844 N. Nob Hill Rd., Suite 233, Plantation, FL (US) 33322; Steven Peace, 745 Hidden Valley Dr., Whitefish, MT (US) 59937

( * ) Notice: Subject to any disclaimer, the term of this patent is extended or adjusted under 35 U.S.C. 154(b) by 0 days.

(21) Appl. No.: 09/433,218

(22) Filed: Nov. 4, 1999

(51) Int. Cl.[7] ..... A45B 19/00
(52) U.S. Cl. ..... 135/25.41; 135/15.1; 135/34.2
(58) Field of Search ..... 135/19.5, 20.3, 135/25.41, 34.2

(56) References Cited

U.S. PATENT DOCUMENTS

| | | | | |
|---|---|---|---|---|
| 139,295 | | 5/1873 | Chevers . | |
| 234,165 | | 11/1880 | Boles et al. . | |
| 892,813 | * | 7/1908 | Dolles | 135/25.41 X |
| 1,587,475 | * | 6/1926 | Davis | 135/25.41 X |
| 1,885,968 | * | 11/1932 | Wedemann | 135/25.41 |
| 1,937,363 | * | 11/1933 | Seraphim | 135/25.41 |
| 2,164,242 | | 6/1939 | Henry . | |
| 3,534,752 | * | 10/1970 | Vanzini . | |
| 5,111,835 | | 5/1992 | Lin . | |
| 5,135,017 | | 8/1992 | Fujiyama . | |
| 5,188,137 | | 2/1993 | Simoneli . | |
| 5,285,803 | | 2/1994 | Baldwin et al. . | |
| 5,385,162 | | 1/1995 | Wu . | |
| 5,495,866 | | 3/1996 | Lu . | |
| 5,690,131 | | 11/1997 | Voigt . | |
| 5,823,213 | | 10/1998 | Patarra . | |

FOREIGN PATENT DOCUMENTS

| | | | | |
|---|---|---|---|---|
| 140937 | * | 12/1930 | (AU) | 135/25.41 |
| 1429394 | * | 1/1966 | (FR) | 135/25.41 |
| 2681224 | * | 3/1993 | (FR) | 135/19.5 |
| 340132 | * | 12/1930 | (GB) | 135/25.41 |

* cited by examiner

*Primary Examiner*—Robert Canfield
(74) *Attorney, Agent, or Firm*—Nixon Peabody LLP; Donald R. Studebaker

(57) ABSTRACT

An improved retractable umbrella including a canopy, a plurality of extending arms for supporting the canopy, an outer housing having an interior cavity for housing the canopy and the plurality of extending arms, and a collapsing mechanism for pivoting the plurality of extending arms upwardly into a substantially vertical position from an open configuration to collapse the canopy upwardly into an inverted closed configuration thereby allowing retraction of the canopy and the plurality of extending arms into the interior cavity of the outer housing. In one embodiment, the retractable umbrella also includes a displaceable member positioned in the interior cavity of the outer housing and a center shaft extending into the interior cavity and being displaceable therewithin from outside of the outer housing. The displaceable member has a central opening through which the center shaft extends. The retractable umbrella also includes a plurality of extending arms pivotally mounted to at least one of the displaceable member and the center shaft and a plurality of support arms, each having a first end and a second end, the first end being hingably mounted to at least one of the plurality of extending arms and the second end being hingably mounted to the other of the displaceable member and the center shaft. A canopy is centrally supported at an end of the center shaft and peripherally supported at ends of the plurality of extending arms.

14 Claims, 2 Drawing Sheets

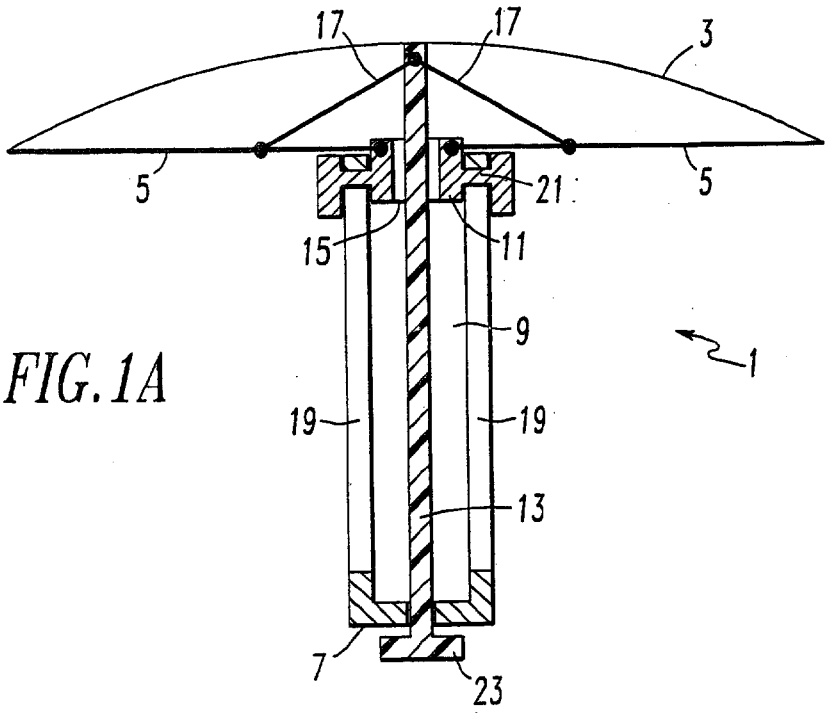
FIG. 1A
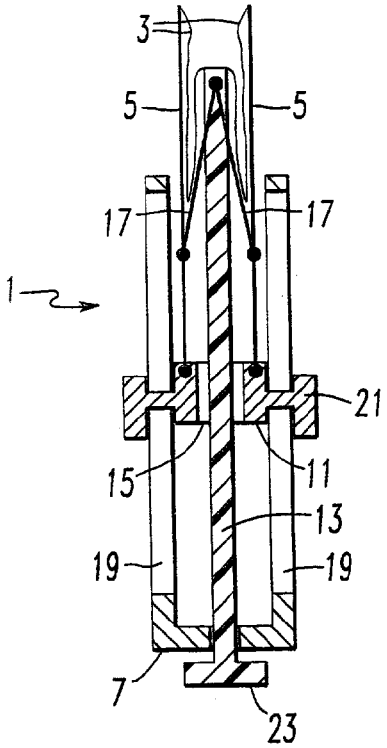
FIG. 1B
FIG. 1C
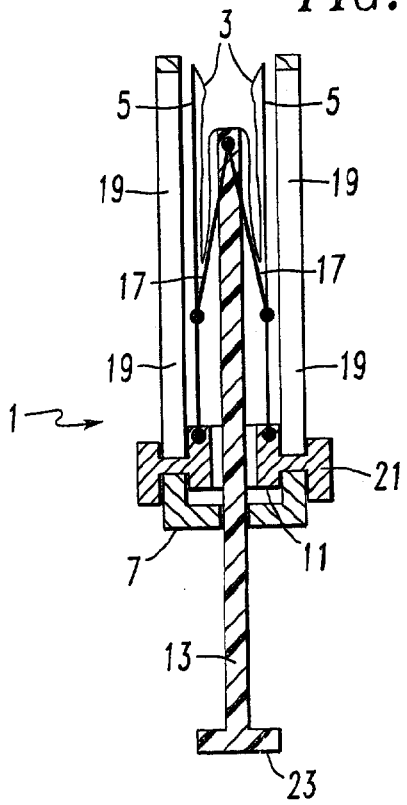

RETRACTABLE UMBRELLA

BACKGROUND OF THE INVENTION

1. Field of the Invention

The present invention is related to the field of umbrellas. More specifically, the present invention relates to umbrellas with a collapsible canopy which is retractable into an outer housing.

2. Description of Related Art

Various umbrella designs are well known in the prior art and are used for providing weather protection. Conventional umbrellas typically include a central rod and a canopy provided at one end which is collapsible downwardly around the central rod when the umbrella is not in use. Other conventional umbrella designs include folding canopies that make the umbrella compact. However, all these conventional umbrella designs share a limitation in that after use in the rain, the water which remains on the canopy can easily drip on to the umbrella user as the umbrella is downwardly collapsed into a closed configuration. In this regard, a substantial quantity of water may drip down to wet the user, especially if the umbrella allows rain to pool on its canopy. In addition, because the collapsed canopy material is exposed when the umbrella is closed, the water on the collapsed canopy can also easily wet the user's clothing, a vehicle interior, the floor, etc. (i.e. where ever the umbrella is stored after use). Moreover, because the collapsed canopy material is exposed, the umbrella has a cluttered appearance which is aesthetically undesirable.

Different umbrella designs where the collapsible canopy is retracted into an outer housing are also known in the prior art. For example, U.S. Pat. No. 5,690,131 to Voigt discloses a foldable umbrella including a hollow central shank assembly with a displaceable piston plate to which flexible support ribs and central edges of the canopy are attached. The other ends of the flexible supports are attached to the peripheral edges of the canopy and are positioned to protrude through horizontal guides at the tip of the shank assembly which lend support to the flexible supports. The umbrella is opened by displacing the piston plate via a telescopic shaft toward the guides such that the flexible supports extend radially outwardly through the horizontal guides into an open position. Extension of the flexible supports causes the flexible supports to pull the canopy out from the shank assembly, effectively creating an umbrella. The umbrella is closed by pulling the piston away from the guides which reverses the described opening process and pulls the flexible supports and the canopy into the shank assembly.

Similar to the foregoing, U.S. Pat. No. 5,188,137 to Simonelli discloses an umbrella that consists of an elongated hollow shaft having an open top for housing flexible ribs similar to that disclosed in Voigt. Simonelli operates the canopy so that the ribs, together with the canopy, extends from the top of the handle in the open configuration and the ribs and the canopy are retracted into the handle in the closed configuration. Simonelli differs from Voigt in that instead of a pushing a telescopic shaft, Simonelli provides a slidable mechanism which slide along the hollow shaft to displace a runner to which the flexible ribs are attached.

These umbrella designs do alleviate some of the disadvantages of the more conventional umbrella designs in that they encase the collapsed canopy in an outer shaft when the umbrella is closed so that water drip is reduced when the umbrella is stored after use. In addition, because these umbrella designs also encase the collapsed canopy, it allows the umbrella to have a clean and uncluttered outward appearance which is aesthetically much more desirable than conventional umbrellas. However, these designs still have some significant disadvantages that are not addressed or are introduced by the nature of their design.

First, these designs of Voigt and Simonelli still have the tendency to allow the user to get wet by the accumulated water on the canopy as the canopy is being retracted into the outer housing since the downwardly arched shape of the fully opened canopy is maintained for at least a substantial portion of the closing process. In addition, the use of flexible ribs and proper design of such ribs have been found to be difficult and costly since they need to be flexible enough to be encased in the outer housing while at the same time, be rigid enough to fully and functionally support the canopy. In this regard, these types of designs have been found to be especially prone to inversion of the canopy than conventional umbrella designs during windy conditions and when there is buffeting of the wind as caused by building structures etc. While this allows gust alleviation and minimizes potential damage to these retractable umbrellas, it has been found that when enough flexibility is designed into the flexible ribs to allow retraction into the outer housing, the flexible ribs were easily inverted by the slighted wind gust and buffeting. Of course, such frequent inversion of the canopy is undesirable and aggravate the user of the umbrella who must correct the inverted condition. This ease of inversion is also attributable to the lack of any structurally reinforcing members that support the proper orientation of the canopy. Furthermore, because significant amount of frictional contact occurs between the end of the outer housing, the flexible ribs and the canopy during the retraction of the umbrella into its closed configuration, these umbrella designs have been found to be much less durable than conventional umbrellas. The frictional contact has been found to rub and wear the components such as the flexible ribs and the canopy material. In addition, the canopy material often became pinched during the opening or closing of the umbrella thereby binding the umbrella in a partially open state and unreliable.

Therefore, there is an unfulfilled need for an improved umbrella that may be retracted into an outer housing which minimizes the potential for wetting the user when the canopy is being retracted. There is also an unfulfilled need for such an umbrella which is cost effective and avoids the design difficulties of the prior art designs. There is further an unfulfilled need for such an umbrella which is resistant to inverting during windy conditions, minimizes frictional contact during operation to improve the durability of the umbrella and minimizes binding of the canopy to improve reliability of the umbrella.

BRIEF SUMMARY OF THE INVENTION

In view of the foregoing, it is an object of the present invention to provide an improved umbrella which is retractable into an outer housing that minimizes the tendency for allowing the user to get wet by the accumulated water on the canopy as the canopy is collapsed.

A second object of the present invention is to provide an improved retractable umbrella that is cost effective and avoids the design difficulties of the prior art.

A third object of the present invention is to proved an improved retractable umbrella that also minimizes tendency for inversion during windy conditions.

Yet another object of the present invention is to provide an improved retractable umbrella that minimizes frictional contact during operation to improve the durability of the umbrella.

Still further, it is an object of the present invention to provide an improved retractable umbrella that minimizes binding of the canopy to improve reliability of the umbrella.

In accordance with preferred embodiments of the present invention, these objects are obtained by an improved retractable umbrella including a canopy for at least partially sheltering a user when the retractable umbrella is in an open configuration, a plurality of extending arms for supporting the canopy when the retractable umbrella is in the open configuration, an outer housing having an interior cavity for housing the canopy and the plurality of extending arms when the retractable umbrella is in a retracted configuration, and a collapsing means for pivoting the plurality of extending arms upwardly into a substantially vertical position from the open configuration thereby collapsing the canopy upwardly into an inverted closed configuration and allowing retraction of the canopy and the plurality of extending arms into the interior cavity of the outer housing.

In one embodiment of the present invention, the retractable umbrella includes an outer housing having an interior cavity, a displaceable member positioned in the interior cavity of the outer housing and a center shaft extending into the interior cavity and being displaceable therewithin from outside of the outer housing. The displaceable member has a central opening through which the center shaft extends. The retractable umbrella also includes a plurality of extending arms pivotally mounted to at least one of the displaceable member and the center shaft and a plurality of support arms, each having a first end and a second end, the first end being hingably mounted to at least one of the plurality of extending arms and the second end being hingably mounted to the other of the displaceable member and the center shaft. A canopy is centrally supported at an end of the center shaft and peripherally supported at ends of the plurality of extending arms. In accordance with the present invention, at least one of the canopy and the plurality of extending arms is housed in the interior cavity of the outer housing when the retractable umbrella is in a retracted configuration. In operation, the plurality of extending arms are extended outside of the interior cavity of the outer housing by displacing the center shaft inwardly into the interior cavity. In addition, the plurality of extending arms are retracted into the interior cavity of the outer housing by displacing the center shaft outwardly from the interior cavity.

More specifically, a retractable umbrella in accordance with one embodiment of the present invention may be retracted into a retracted configuration by pivoting the plurality of extending arms upwardly into a substantially vertical position to collapse the canopy upwardly into an inverted closed configuration, and retracting the plurality of extending arms into the interior cavity. In this regard, the plurality of extending arms may be pivotally mounted to the displaceable member, the first end of each of the plurality of support arms may be hingably mounted to each of the plurality of extending arms, and the second end of each of the plurality of support arms may be hingably mounted to the center shaft. In this embodiment, the outer housing may include a plurality of slots for guiding the displaceable member within the interior cavity, and the displaceable member may have a plurality of extension portions that extend out of the interior cavity through the plurality of slots to allow manual displacement of the displaceable member. The plurality of extending arms may be extended from within the interior cavity into the substantially vertical position by displacing the center shaft inwardly into the interior cavity. In this regard, the retractable umbrella may further include a displacement limiter on the center shaft for limiting displacement of the center shaft inwardly into the interior cavity. In addition, the plurality of extending arms may be retracted into the interior cavity of the outer housing by displacing the center shaft outwardly from the interior cavity. The canopy may be expanded from the inverted closed configuration to a fully open configuration by further displacing the displaceable member upwardly after the center shaft is displaced inwardly into the interior cavity. In this regard, the retractable umbrella may be provided with a locking means for maintaining the displaceable member in an upwardly displaced position. In the preferred embodiment, the displaceable member may be a substantially annular ring and the plurality of extending arms are preferably substantially rigid.

In an alternative embodiment of the present invention, the plurality of extending arms may be pivotally mounted to the center shaft, the first end of each of the plurality of support arms may be hingably mounted to each of the plurality of extending arms, and the second end of each of the plurality of support arms may be hingably mounted to the displaceable member. The retractable umbrella of this embodiment may also include a spring positioned in the interior cavity of the outer housing for biasing the displaceable member within the interior cavity in a manner to extend the plurality of extending arms upwardly into the substantially vertical position. In addition, the center shaft may be mechanically connected to the displaceable member in a manner that the center shaft is also biased by the spring via the displaceable member. Like the other embodiment, the plurality of extending arms may be extended from within the interior cavity into the substantially vertical position by displacing the center shaft inwardly into the interior cavity. The plurality of extending arms may also be correspondingly retracted into the interior cavity by displacing the center shaft outwardly from the interior cavity. In addition, the plurality of extending arms are preferably substantially rigid. Moreover, the canopy is expanded from the inverted closed configuration to a fully open configuration by further displacing the center shaft member upwardly beyond displacement of the displaceable member. In this regard, the retractable umbrella may also be provided with a displacement limiter on the center shaft for limiting displacement of the center shaft inwardly into the interior cavity and also be provided with a locking means for maintaining a retracted position of the displaceable member in the interior cavity against a biasing force of the spring.

These and other objects, features and advantages of the present invention will become more apparent from the following detailed description of the preferred embodiments of the invention when viewed in conjunction with the accompanying drawings.

BRIEF DESCRIPTION OF THE DRAWINGS

FIG. 1A is a cross-sectional view of a retractable umbrella in accordance with one embodiment of the present invention in a fully opened configuration.

FIG. 1B is a view of the retractable umbrella of FIG. 1A with the plurality of extending arms in a substantially vertical position.

FIG. 1C is a view of the retractable umbrella of FIG. 1B but with the canopy removed and the plurality of extending arms retracted in a retracted configuration of the retractable umbrella.

DETAILED DESCRIPTION OF THE INVENTION

Figure 2A:
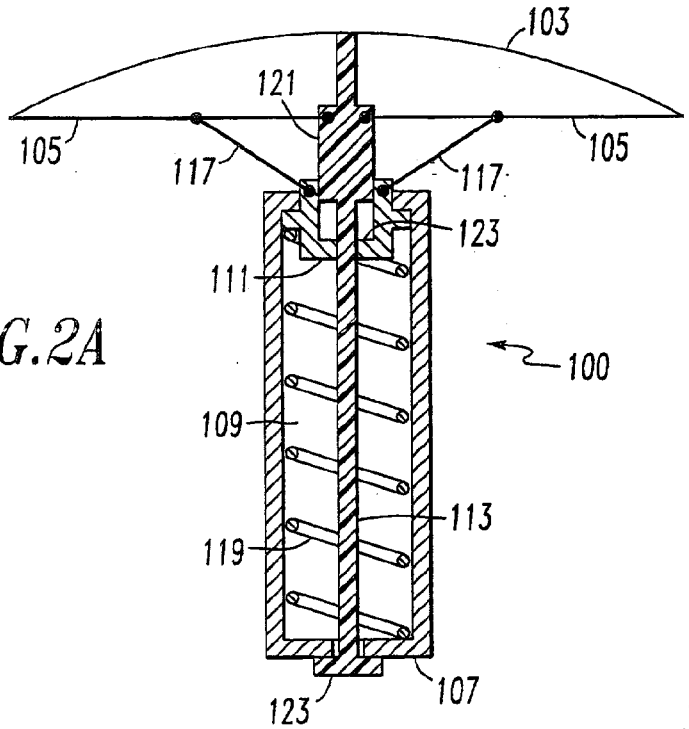
FIG. 2 is a cross-sectional view of a retractable umbrella in accordance with another embodiment of the present invention in a fully opened configuration.
FIG. 2B is a view of the retractable umbrella of FIG. 2A with the plurality of extending arms in a substantially vertical position.
FIG. 2C is a view of the retractable umbrella of FIG. 2B but with the canopy removed and the plurality of extending arms retracted in a retracted configuration of the retractable umbrella.
Figure 2B:
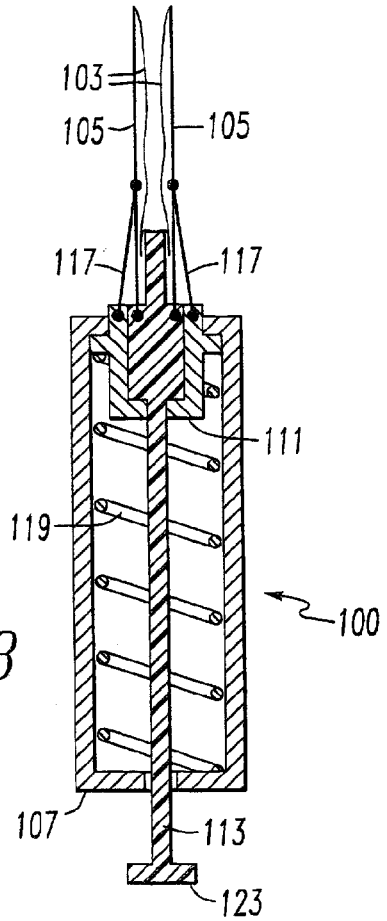
Figure 2C:
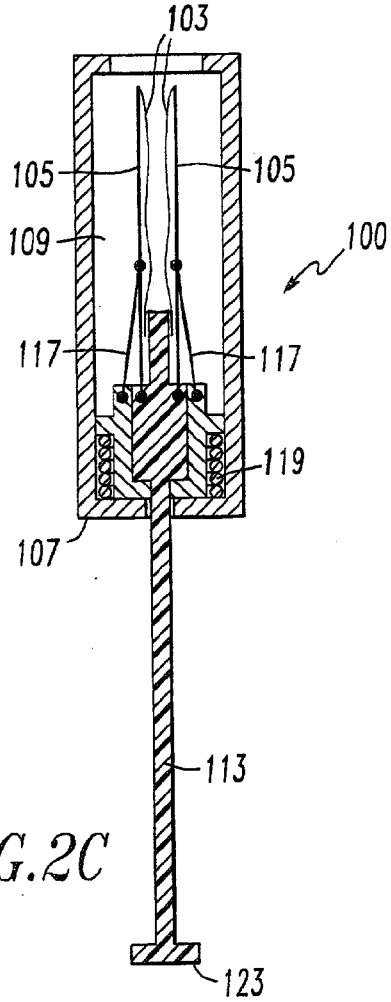

Initially, it is noted that FIGS. 1A–1C and FIGS. 2A–2C illustrate two different embodiments of the retractable umbrella in accordance with the present invention, each of which will be discussed in further detail below. The present invention provides an umbrella which may be retracted into an outer housing while minimizing the potential for wetting the user. As will be evident from the detailed discussion below, the retractable umbrella in accordance with the present invention is cost effective and avoids the design difficulties of the prior art designs. In addition, the present invention provides a retractable umbrella which is resistant to inverting during windy conditions, minimizes frictional contact during operation to improve the durability of the umbrella, and minimizes binding of the canopy to improve reliability of the umbrella. From examination of FIGS. 1A–1C, it can be readily appreciated that each of these figures show different configurations of the same retractable umbrella 1 during use so that its operation is most clearly illustrated. FIGS. 2A–2C similarly shows different configuration of a second embodiment of the present invention. It should also be noted that the shape and sizes of the various components of the umbrella 1 as described hereinbelow with respect to FIGS. 1A–1C and FIGS. 2A–2C are for illustrative purposes only and are not exactly to scale. One skilled in the art would be able to modify the illustrated embodiments to derive the geometric proportions which is most desirable in any given application. Moreover, while it is envisioned that the present invention may be used as a personal umbrella, it may also be applied to patio table umbrellas, cart umbrellas and other applications as well.

Referring more specifically to FIGS. 1A–1C, an improved retractable umbrella 1 in accordance with one embodiment of the present invention is shown. The retractable umbrella 1 includes a canopy 3 for at least partially sheltering a user from the elements such as rain, snow, wind etc. when the retractable umbrella 1 is in an open configuration shown in FIG. 1A. The retractable umbrella 1 includes a plurality of extending arms 5 for peripherally supporting the canopy 3 when the retractable umbrella 1 is in the open configuration. The retractable umbrella 1 also includes an outer housing 7 with an interior cavity 9 for housing the canopy 3 and the plurality of extending arms 5 when the retractable umbrella 1 is in a retracted configuration as shown in FIG. 1C (the canopy 3 being omitted in FIG. 1C for the sake of clearly showing the substantially vertical position of the plurality of extending arms 5). In this regard, the retractable umbrella 1 further includes a collapsing mechanism or means discussed further below for pivoting the plurality of extending arms 5 upwardly into a substantially vertical position as shown in FIG. 1B from the open configuration of FIG. 1A. This collapsing of the canopy 3 upwardly into an inverted closed configuration shown in FIG. 1B allows the retraction of the canopy 3 and the plurality of extending arms 5 into the interior cavity 9 of the outer housing 7 in the manner shown in FIG. 1C.

In the illustrated embodiment of FIGS. 1A–1C, the collapsing mechanism or means of the retractable umbrella 1 includes a displaceable member 11 positioned in the interior cavity 9 of the outer housing 7 and a center shaft 13 which extends into the interior cavity 9 and is displaceable therewithin from outside of the outer housing 7. The displaceable member 11 has a central opening 15 through which the center shaft 13 extends. The plurality of extending arms 5 which are preferably substantially rigid, are pivotally mounted to the displaceable member 11. There are also provided a plurality of support arms 17, the first end of each of the plurality of support arms 17 being hingably mounted to each of the plurality of extending arms 5, and the second end of each of the plurality of support arms 17 being hingably mounted to the center shaft 13. The canopy 3 is centrally supported at an end of the center shaft 13 as well as being peripherally supported at ends of the plurality of extending arms 5. The outer housing 7 also includes a plurality of slots 19 for guiding the displaceable member 11 within the interior cavity 9. In this regard, the displaceable member 11 may be an annular ring with a plurality of extension portions 21 that extend out of the interior cavity 9 through the plurality of slots 19 thereby allowing manual displacement of the displaceable member 11.

In the retractable umbrella of the illustrated embodiment, the canopy 3 and the plurality of extending arms 5 can both be housed in the interior cavity 9 of the outer housing 7 when the retractable umbrella 1 is in a retracted configuration a shown in FIG. 1C. In use, the retractable umbrella 1 is retracted into a retracted configuration of FIG. 1C from the open configuration of FIG. 1A by first pivoting the plurality of extending arms 5 upwardly into a substantially vertical position as shown in FIG. 1B. The substantially vertical position of the plurality of extending arms 5 as shown in FIG. 1B is attained by downwardly displacing the displaceable member 11 within the interior cavity 9. This downward displacement may be effectuated manually by the user by displacing the extension portions 21 of the displaceable member 11. Because the plurality of extending arms 5 are pivotally attached to the displaceable member 11 while the plurality of supporting arms 17 are hingably mounted to the center shaft 13 which remains stationary at this point, the downward displacement of the displaceable member 11 causes the plurality of extending arms 5 to pivot upwardly into the substantially vertical position shown in FIG. 1B.

As most clearly shown in FIG. 1B, because the canopy 3 is centrally supported at an end of the center shaft 13 as well as being peripherally supported at ends of the plurality of extending arms 5, the canopy 3 collapses upwardly together with the plurality of extending arms 5 into an inverted closed configuration as shown by the dotted lines of FIG. 1B (the canopy 3 being illustrated with dotted lines to clearly distinguish it form the plurality of extending arms 5). In this regard, the canopy 3 is preferably made of a flexible fabric or other flexible material known in the art so that it can be collapsed and be disposed between the plurality of extending arms 5 in the manner shown in FIG. 1B.

The canopy 3, together with the plurality of extending arms 5, are then retracted into the interior cavity 9 by displacing the center shaft 13 outwardly from the interior cavity 9 into a position shown in FIG. 1C. Because the plurality of extending arms 5 are pivotally mounted to the displaceable member 11, they are guided along the interior cavity 9 via the plurality of slots 19. As noted previously, the canopy 3 is not illustrated in FIG. 1C for the sake of clearly showing the substantially vertical position of the plurality of extending arms 5.

In a corresponding manner, the retractable umbrella 1 is configurable into the open configuration shown in FIG. 1A from the retracted configuration of FIG. 1C by reversing the above described operation. In particular, the plurality of extending arms 5 are first extended from within the interior cavity 9 of the outer housing 7 into the substantially vertical position of FIG. 1B by displacing the center shaft 13 inwardly into the interior cavity 9. The canopy 3 is then expanded from the inverted closed configuration of FIG. 1B to a fully open configuration of FIG. 1A by further displacing the displaceable member 11 upwardly after the center shaft 13 has been displaced inwardly into the interior cavity 9.

It should be noted that to properly attain in the open configuration, the center shaft 13 should be properly dimensioned and may be provided with a displacement limiter such as a stop member 23 to limit the displacement of the center shaft 13 such that when the center shaft 13 is fully displaced inwardly into the interior cavity 9, the canopy 3 is in its fully opened configuration as shown in FIG. 1A. Otherwise, the canopy 3 may not attain its fully opened. In addition, whereas in the illustrated embodiment, the displacement limiter is a stop member 23 which abut an end of the outer housing 7, alternative displacement limiters may be provided as well. Moreover, to maintain the open configuration of the retractable umbrella 1, a locking means (not shown) may be provided to maintain the displaceable member 11 in the upwardly displaced position shown in FIG. 1A. Such locking means may be of the conventional pop-up button type well known in the art or may be any other locking means such as a pin, retainer, hinge lock, etc. Of course, such a locking means must be unlocked when the retractable umbrella 1 is to be closed and retracted into the outer housing 7.

FIGS. 2A–2C show a retractable umbrella 100 in accordance with an alternative embodiment the present invention. Like the previous embodiment discussed above, the retractable umbrella 100 includes a canopy 103 for at least partially sheltering the user from the elements when the retractable umbrella 100 is in an open configuration shown in FIG. 2A. The retractable umbrella 100 includes a plurality of extending arms 105 for peripherally supporting the canopy 103 when the retractable umbrella 1 is in the open configuration. The retractable umbrella 100 also includes an outer housing 107 having an interior cavity 109 for housing the canopy 103 and the plurality of extending arms 105 when the retractable umbrella 100 is in a retracted configuration as shown in FIG. 2C.

In this second embodiment, the plurality of extending arms 105 are pivotally mounted to the center shaft 113 and unlike the first embodiment discussed previously, the first end of each of the plurality of support arms 117 are hingably mounted to each of the plurality of extending arms 105 while the second end of each of the plurality of support arms 117 are hingably mounted to the displaceable member 111. The retractable umbrella 100 also includes a spring 119 positioned in the interior cavity 109 of the outer housing 107 for biasing the displaceable member 111 within the interior cavity 109 in a manner to extend the plurality of extending arms 105 upwardly into the substantially vertical position as shown in FIG. 2B. In addition, in the illustrated embodiment, the center shaft 113 is mechanically connected to the displaceable member 111 in a manner that the center shaft 113 is also biased by the spring 119 through the displaceable member 111. In the embodiment shown, this mechanical connection may be attained by providing a protruded portion 121 on the center shaft 113 such that the protruded portion 121 abuts against a protrusion seat 123 on the displaceable member 111 in the manner shown in FIGS. 2B and 2C.

Like the previously discussed embodiment, the canopy 103 and the plurality of extending arms 105 are both housed in the interior cavity 109 of the outer housing 107 when the retractable umbrella 100 is in a retracted configuration a shown in FIG. 2C (the canopy 103 being omitted in FIG. 2C for the sake of clearly showing the substantially vertical position of the plurality of extending arms 105). The retractable umbrella 100 is retracted into a retracted configuration of FIG. 2C from the open configuration of FIG. 2A by first pivoting the plurality of extending arms 105 upwardly into a substantially vertical position as shown in FIG. 2B. However, unlike the prior embodiment, this substantially vertical position of the plurality of extending arms 105 as shown in FIG. 2B is attained by first displacing the center shaft 113 downwardly within the interior cavity 109 relative to the displaceable member 111, the displaceable member being held relatively stationary at this point due to the biasing force of the spiring 119. This relative movement between the center shaft and the displaceable member 111 causes the plurality of support arms 117 to act upon and pivot the plurality of extending arms 105 into the substantially vertical position of FIG. 2B at which the protruded portion 121 on the center shaft 113 abuts against the protrusion seat 123 so that relative movement no longer occurs. As most clearly shown in FIG. 2B, because the canopy 103 is centrally supported at an end of the center shaft 113 as well as being peripherally supported at ends of the plurality of extending arms 105, the canopy 103 collapses upwardly together with the plurality of extending arms 105 into an inverted closed configuration as shown by the dotted lines of FIG. 2B (the canopy 103 being illustrated with dotted lines to clearly distinguish it form the plurality of extending arms 105). Again, the canopy 103 is preferably made of a flexible fabric or other flexible material known in the art so that it can be collapsed and be disposed between the plurality of extending arms 105 in the manner shown.

Once the plurality of extending arms 105 are in a substantially vertical position as shown in FIG. 2B, the canopy 103, together with the plurality of extending arms 105 are then retracted into the interior cavity 109 by further displacing the center shaft 113 outwardly from the interior cavity 109 into a position shown in FIG. 2C. Because the protruded portion 121 on the center shaft 113 abuts against the protrusion seat 123 of the displaceable member 111, relative movement between the center shaft 113 and the displaceable member 111 no longer occurs. Therefore, the outward displacement of the center shaft 113 causes the displacement of the displaceable member 111 and correspondingly, causes the plurality of extended arms 105 and the plurality of support arms 117 to be retracted into the interior cavity 109 of the outer housing 107 as shown in FIG. 2C.

Also in a corresponding manner, the retractable umbrella 100 is configurable into the open configuration shown in FIG. 2A from the retracted configuration of FIG. 2C by first extending the plurality of extending arms 105 from within the interior cavity 109 of the outer housing 107 into the substantially vertical position of FIG. 2B. It should be noted that this operation is actually automated in the embodiment shown since the spring 119 biases the displaceable member 111 (together with the center shaft 113) into the extended position shown in FIG. 2B. The canopy 103 may then be expanded from the inverted closed configuration of FIG. 2B to a fully open configuration of FIG. 2A by further displacing the center shaft 113 upwardly such that the protruded portion 121 on the center shaft 113 lifts off of the protrusion seat 123 of the displaceable member 111 thereby causing relative movement between these components and expanding the canopy 103.

It should be noted that like the first embodiment, the center shaft 113 should be properly dimensioned and may be provided with a displacement limiter such as a stop member 123 to limit the displacement of the center shaft 113 such that when the center shaft 113 is fully displaced inwardly into the interior cavity 109, the canopy 103 is in its fully opened configuration as shown in FIG. 2A. Again, whereas in the illustrated embodiment, the displacement limiter is a stop member 123 which abut an end of the outer housing 107, alternative displacement limiters may be provided as well. In addition, to maintain the open configuration of the retractable umbrella 100, a locking means (not shown) may be provided to maintain the center shaft 113 in the upwardly displaced position shown in FIG. 1A. Such locking means may be of the conventional pop-up button type well known in the art or may be any other locking means such as a pin, retainer, hinge lock, etc. Of course, such a locking means must be unlocked when the retractable umbrella 100 is to be closed and retracted into the outer housing 7. Alternatively, the center shaft 113 may itself be spring biased relative to the displaceable member 111 so that such a locking means is not required and the opening of the retractable umbrella 111 is fully automated. Nonetheless, due to the spring 119, a locking means (not shown) for maintaining the retracted configuration of FIG. 2C should be provided so that the plurality of extending arms 105 are not unintentionally extended out of the outer housing 107. Such a locking means must be unlocked when using the retractable umbrella 100.

In the above described manner, the above described embodiments of the present invention as shown in FIGS. 1A–1C and 2A–2C provide a retractable umbrella 1, 100 that may be retracted into an outer housing 7, 107. Because the canopy 3, 103 collapses upwardly into an inverted closed configuration, the present invention minimizes the potential for wetting the user with any water that may have puddled on the surface of the canopy 3, 103. In addition, the retractable umbrella 1, 100 may be manufactured in a very cost effective manner while avoiding the design difficulties of the prior art designs since the plurality of extending arms 5, 105 as well as the plurality of support arms 17, 117, may be made of drawn metal wire as used in conventional umbrella designs. Similarly, the center shaft 13, 113 and the outer housing 17, 117 may be made of metal tubes which is also used in conventional umbrella designs or even be made of plastics or composites to reduce weight. Likewise, the displaceable members 11, 111 can be made of plastics, composites or nylon. Of course, it should be recognized that the above materials are only given as examples and any these components may be made from any suitable material. Moreover, the center shaft 13, 113 may also be made to be collapsible so that the overall length of the retractable umbrella 1, 100 can be substantially reduced when it is in a retracted configuration. This may be attained by using a telescoping type center shaft (not shown) which are used in conventional umbrella designs and known in the art. Moreover, an extended handle (not shown) and even an extended shaft (which may be collapsible) may also be provided at the end of the center shaft 13, 113 so that the user of the retractable umbrella 1, 100 can easily grip and operate the umbrella.

As can be appreciated, the plurality of extending arms 5, 105 and the plurality of support arms 17, 117 act to provide a retractable umbrella which is resistant to inverting during windy conditions. As noted previotisly, because these components may be made of drawn metal wire, they are substantially rigid and the attachment of the support arms 17, 117 further reinforce the rigidity of the canopy 3, 103 in its fully open configuration to resist inverting as compared to the prior art designs. In this regard, the added costs and the design difficulties associated with providing a flexible ribs of the prior art designs are avoided. In addition, in alternative embodiments, the retractable umbrellas 1, 100 may include canopy supporting ribs (not shown) which may extend from the end of the center shaft 13, 113 to the peripheral end of the plurality of extending arms 5, 105 to provide further support for the canopy 3, 103.

Furthermore, because the plurality of extended arms 5, 105 and the canopy 3, 103 collapses upwardly into an inverted closed configuration before being retracted into the housing, frictional contact between the components of the retractable umbrella 1, 100 and the potential for binding of the canopy are minimized during the umbrella's operation. This minimization of frictional contact and potential for binding improves the durability and the reliability of the umbrella thereby ensuring extended life of the product and satisfaction to the user.

From the foregoing, it should now be apparent how the present invention provides an improved retractable umbrella which may be retracted into an outer housing that minimizes the tendency for wetting the user. In addition, it can be seen how the present invention provides a cost effective retractable umbrella while avoiding the design difficulties of the prior art designs. Furthermore, it can be seen how the present invention provides a retractable umbrella which is resistant to inverting during windy conditions, minimizes frictional contact during operation to improve the durability of the umbrella, and minimizes binding of the canopy to improve reliability of the umbrella.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims.

What is claimed is:

1. A retractable umbrella comprising:

an outer housing having an interior cavity;

a displaceable member positioned in said interior cavity of said outer housing, said displaceable member having a central opening;

a center shaft extending into said interior cavity and being displaceable therewithin from outside of said outer housing, said center shaft extending through said central opening of said displaceable member;

a plurality of extending arms pivotally mounted to at least one of said displaceable member and said center shaft;

a plurality of support arms each having a first end and a second end, said first end being hingably mounted to at least one of said plurality of extending arms and said second end being hingably mounted to the other of said at least one of said displaceable member and said center shaft; and a canopy centrally supported at an end of said center shaft and peripherally supported at ends of said plurality of extending arms;

wherein at least one of said canopy and said plurality of extending arms is housed in said interior cavity of said outer housing when said retractable umbrella is in a retracted configurations, with said retracted configuration being attained by pivoting said plurality of extending arms upwardly into a substantially vertical position to collapse said canopy upwardly into an inverted closed configuration and retracting said plurality of extending arms into said interior cavity; said plurality of extending arms are pivotally mounted to said displaceable member, said first end of each of said plurality of support arms is hingably mounted to each of said plurality of extending arms, and said second end of each of said plurality of support arms is hingably mounted to said center shaft and said outer housing includes a plurality of slots for guiding said displaceable member within said interior cavity.

2. A retractable umbrella of claim 1, wherein said plurality of extending arms are extended outside of said interior cavity of said outer housing by displacing said center shaft inwardly into said interior cavity.

3. A retractable umbrella of claim 2, wherein said plurality of extending arms are retracted into said interior cavity of said outer housing by displacing said center shaft outwardly from said interior cavity.

4. A retractable umbrella of claim 1, wherein said displaceable member has a plurality of extension portions that extend out of said interior cavity through said plurality of slots to allow manual displacement of said displaceable member.

5. A retractable umbrella of claim 4, wherein said plurality of extending arms are extended from within said interior cavity into said substantially vertical position by displacing said center shaft inwardly into said interior cavity, and said plurality of extending arms are retracted into said interior cavity of said outer housing by displacing said center shaft outwardly from said interior cavity.

6. A retractable umbrella of claim 5, further comprising a displacement limiter on said center shaft for limiting displacement of said center shaft inwardly into said interior cavity.

7. A retractable umbrella of claim 5, wherein said canopy is expanded from said inverted closed configuration to a fully open configuration by further displacing said displaceable member upwardly after said center shaft is displaced inwardly into said interior cavity.

8. A retractable umbrella of claim 7, wherein said displaceable member is a substantially annular ring and said plurality of extending arms are substantially rigid.

9. A retractable umbrella comprising:

an outer housing having an interior cavity;

a displaceable member positioned in said interior cavity of said outer housing, said displaceable member having a central opening;

a center shaft extending into said interior cavity and being displaceable therewithin from outside of said outer housing, said center shaft extending through said central opening of said displaceable member;

a plurality of extending arms pivotally mounted to at least one of said displaceable member and said center shaft;

a plurality of support arms each having a first end and a second end, said first end being hingably mounted to at least one of said plurality of extending arms and said second end being hingably mounted to the other of said at least one of said displaceable member and said center shaft; and a canopy centrally supported at an end of said center shaft and peripherally supported at ends of said plurality of extending arms;

wherein said retracted configuration is attained by pivoting said plurality of extending arms upwardly into a substantially vertical position to collapse said canopy upwardly into an inverted closed configuration and retracting said plurality of extending arms into said interior cavity, with said plurality of extending arms being pivotally mounted to said center shaft, said first end of each of said plurality of support arms is hingably mounted to each of said plurality of extending arms, and said second end of each of said plurality of support arms is hingably mounted to said displaceable member.

10. A retractable umbrella of claim 9, further comprising a spring positioned in said interior cavity of said outer housing for biasing said displaceable member within said interior cavity in a manner to extend said plurality of extending arms upwardly into said substantially vertical position.

11. A retractable umbrella of claim 10, wherein said center shaft is mechanically connected to said displaceable member in a manner that said center shaft is also biased by said spring via said displaceable member.

12. A retractable umbrella of claim 11, wherein said plurality of extending arms are extended from within said interior cavity into said substantially vertical position by displacing said center shaft inwardly into said interior cavity, and said plurality of extending arms are retracted into said interior cavity by displacing said center shaft outwardly from said interior cavity.

13. A retractable umbrella of claim 12, wherein plurality of extending arms are substantially rigid and said canopy is expanded from said inverted closed configuration to a fully open configuration by further displacing said center shaft member upwardly beyond displacement of said displaceable member.

14. A retractable umbrella of claim 13, further comprising a displacement limiter on said center shaft for limiting displacement of said center shaft inwardly into said interior cavity.

* * * * *